United States Patent [19]

Lechtken et al.

[11] Patent Number: 4,929,249

[45] Date of Patent: May 29, 1990

[54] DISCHARGE AND DISCHARGE RESIST PRINTING USING AMINOREDUCTONES

[75] Inventors: Peter Lechtken, Frankenthal; Peter Kutschera, Ludwigshafen, both of Fed. Rep. of Germany

[73] Assignee: BASF Aktiengesellschaft, Ludwigshafen, Fed. Rep. of Germany

[21] Appl. No.: 347,223

[22] Filed: May 4, 1989

[30] Foreign Application Priority Data

May 19, 1988 [DE] Fed. Rep. of Germany ..... 3816999

[51] Int. Cl.[5] ..... D06P 5/15; A61K 31/47

[52] U.S. Cl. ..... 8/464; 8/457; 8/582; 8/597; 8/605; 8/607; 8/695; 8/921; 8/922; 8/924

[58] Field of Search ..... 8/464, 607

[56] References Cited

U.S. PATENT DOCUMENTS 4,515,982 5/1985 Lechtken et al. ..... 560/125

4,616,016 10/1986 Lechtken et al. ..... 514/249

*Primary Examiner*—A. Lionel Clingman

*Attorney, Agent, or Firm*—Oblon, Spivak, McClelland, Maier & Neustadt

[57] ABSTRACT

Textile materials made of polyester, triacetate, acetate or polyamide or mixtures thereof are printed by the discharge printing or discharge resist printing technique by using as discharging agent for disperse dyes a 3-aminoreductone of the formula

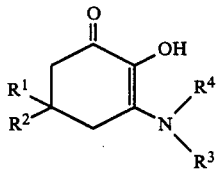

I where $R^1$, $R^2$ and $R^3$ are identical or different and each is hydrogen, methyl or ethyl and $R^4$ is linear or branched alkyl or alkenyl of from 1 to 20 carbon atoms, which may be monosubstituted or polysubstituted by hydroxyl, alkoxy of from 1 to 3 carbon atoms in the alkyl or acetoxy, or is a radical $-(CH_2-CH_2-O)_nH$ where n is from 1 to 10 and which may be etherified with alkyl of from 1 to 3 carbon atoms or esterified with acetyl, or $R^4$ together with the N-atom is the radical of an aliphatic $\alpha$- or $\beta$-amino acid of from 2 to 15 carbon atoms, in which case the carboxyl group may be present in neutralized form as an alkali metal, alkaline earth metal or ammonium salt or in esterified form as a $C_1$–$c_{10}$-alkyl ester, or a mineral acid salt thereof.

4 Claims, No Drawings

DISCHARGE AND DISCHARGE RESIST PRINTING USING AMINOREDUCTONES

The present invention relates to a process for printing polyester, cellulose acetate, cellulose triacetate or polyamide, and textile materials containing mixtures thereof, with dischargeable or discharge-resistant disperse dyes by the discharge printing or discharge resist printing technique, wherein an aqueous discharge or discharge resist print paste which contains an aminoreductone as discharging agent and an aqueous solution of thickener with or without a discharge-resistant disperse dye is printed in a pattern onto the textile material, and the textile material so printed is then fixed and washed.

Discharge printing is the technique where the dyes already present on the textile material are completely or partially destroyed by chemicals applied in a pattern.

In conventional discharge printing, the starting point is a fast ready-produced dyeing, on top of which a discharge paste is printed. In the printed areas, the dischargeable ground dyes are destroyed, leaving white areas. If the discharge paste additionally contains discharge-resistant dyes, colored areas are produced.

A variation on conventional discharge printing is discharge resist printing, where the dyes to be destroyed are situated at the fiber surface in an unfixed state.

The numerous prior art discharge and discharge resist printing processes for printing fiber materials with disperse dyes make use of discharging compositions containing for example a strongly alkaline compound or a reducing agent, such as tin(II) salts, in particular tin(II) chloride, or derivatives of methanesulfinic acid, with which alkali-cleavable or reducible dyes for the ground dyeing on the fiber materials to be printed are destroyed almost completely, while alkali-resistant or non-reducible dyes, included to produce color effects (in contradistinction from white effects if they are absent) in ideally crisply outlined patterns of any desired size on the fiber materials to be printed, are not harmed by the discharging agent. A general overview of redox processes in discharge printing on textiles is given for example in Melliand Textilber. 67 (1986), 896–902.

The discharging agents used in existing processes, however, have inter alia the following disadvantages:

- strong fiber damage due to alkali,
- corrosion of printing machines, in particular steamers, due to HCl formation,
- heavy metal pollution of the effluent on using for example tin salts, and
- air and effluent pollution with formaldehyde on using salts of methanesulfinic acid.

It is an object of the present invention to provide a novel discharging agent whereby the abovementioned disadvantages are largely avoided.

We have found that this object is achieved by using 3-aminoreductones of the formula I

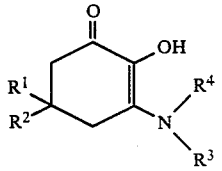

I where $R^1$, $R^2$ and $R^3$ are identical or different and each is hydrogen, methyl or ethyl and $R^4$ is linear or branched alkyl or alkenyl of from 1 to 20 carbon atoms, which may be monosubstituted or polysubstituted by hydroxyl, alkoxy of from 1 to 3 carbon atoms in the alkyl or acetoxy, or is a radical $-(CH_2-CH_2-O)_nH$ where n is from 1 to 10 and which may be etherified with alkyl of from 1 to 3 carbon atoms or esterified with acetyl, or $R^4$ together with the N-atom is the radical of an aliphatic $\alpha$- or $\beta$-amino acid of from 2 to 15 carbon atoms, where the carboxyl group may be present in neutralized form as an alkali metal, alkaline earth metal or ammonium salt or in esterified form as a $C_1$–$C_{10}$-alkyl ester, or mineral acid salts thereof as discharging agents for discharge and discharge resist printing processes to avoid the abovementioned disadvantages.

The present invention accordingly provides novel, advantageous discharging agents. The 3-aminoreductones of the formula I and their salts with mineral acids are highly suitable, by virtue of their powerful reducing action, for the reductive removal of reducible disperse dyes from textile materials containing polyester, acetate, triacetate or polyamide or mixtures thereof.

The compounds of the formula I can be present, owing to the amino group, as mineral acid addition salts. Possibilities are in particular hydrochlorides, sulfates and hydrogensulfates.

If a carboxyl group is present in the radical $R^4$, it is preferably converted into a sodium, potassium, magnesium, calcium or ammonium salt.

An alkyl $R^4$ of from 1 to 20 carbon atoms can be for example n-hexyl, n-octyl, 2-ethylhexyl, 3,5,5-trimethylhexyl, n-decyl or n-dodecyl, the radicals of from 8 to 14 carbon atoms being preferred. Alkenyl is for example octenyl or decenyl.

The alkyl or alkenyl radicals may be substituted by from 1 to 3 OH groups which for example may be etherified with methyl, ethyl or propyl or esterified with acetyl. Examples of alkoxy-containing radicals $R^4$ are ethoxyethyl, polyethoxyethyl, ethoxypropyl, diethoxypropyl, 2-acetoxyethoxyethyl and similar radicals obtained by reaction of ethylene oxide or propylene oxide.

Examples of aliphatic $\alpha$- or $\beta$-amino acids formed by the radical R′ together with the N-atom are glycine, $\alpha$-alanine, $\beta$-alanine, valine, leucine, isoleucine, phenylglycine and $\epsilon$-aminocaproic acid.

Preferred use is made according to the invention of aminoreductones of the formula I, or mineral acid salts thereof, where $R^1$, $R^2$ and $R^3$ are each hydrogen and $R^4$ is linear or branched alkyl of from 8 to 14 carbon atoms, hydroxyethyl or hydroxyethoxyethyl (n=2), or $R^4$ together with the N-atom is the radical of an $\alpha$- or $\beta$-amino acid of from 2 to 6 carbon atoms, in which case the carboxyl group may be present in neutralized form as a sodium, potassium, magnesium, calcium or ammonium salt.

Particularly preferred aminoreductones of the formula I and acid addition salts thereof are those where $R^1$, $R^2$ and $R^3$ are each hydrogen and $R^4$ is derived together with the N-atom from glycine, $\beta$-alanine, $\alpha$-alanine or $\epsilon$-aminocaproic acid and where the carboxyl group may be present as a sodium, potassium, calcium or ammonium salt.

The abovementioned 3-aminoreductones of the formula I are known compounds, having been described for example in European Patents 83,008 and 124,752. This prior art reveals that they are suitable for stabilizing organic compounds or compositions against oxidation and that aminoreductones can influence the growth of animals. It was certainly not obvious, and consequently all the more surprising, that such aminoreductones are useful discharging agents in discharge and discharge resist printing.

The aminoreductones of formula I can be prepared for example exactly as described in European Patents 83,008 and 124,752, so that further details are superfluous.

It is to be noted that the reaction of 2,3-dihydroxycyclohex-2-en-1-one, or of an $R^1$- and $R^2$-substituted derivative as a starting compound, can give rise in particular with an α-amino acid to lactones which to be used according to the invention are subsequently hydrolyzed in a conventional manner.

It follows that the present invention provides for a process for printing a textile material made of polyester, cellulose triacetate, cellulose acetate or polyamide or a mixture thereof with a disperse dye by the discharge printing or discharge resist printing technique, which comprises using as the discharging agent a 3-aminoreductone of the general formula I

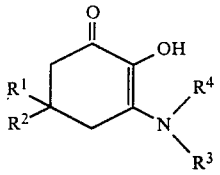

(I)

or an acid addition salt thereof where the symbols are as defined and preferred above, and for the use of an aminoreductone of the formula I or an acid addition salt thereof as a discharging agent for a disperse dye in a discharge or discharge resist printing process.

The most notable advantages of the aminoreductones to be used according to the invention in print pastes are the small amount required, the ready degradability and the avoidance of heavy metals and stabilizers. Moreover, in contradistinction from known discharge print pastes which contain methanesulfinic acid or hexamethylenetetramine, the print pastes according to the invention do not give off formaldehyde in the course of application to textile materials.

The aminoreductones of the formula I are used in a conventional manner in the form of print pastes for discharge or discharge resist printing together with thickeners and with or without discharge-resistant disperse dyes and customary assistants. These print pastes contain, based on the total weight, from 1 to 10% by weight, preferably from 5 to 7% by weight, of an aminoreductone of the formula I or an acid addition salt thereof.

There now follow observations concerning conventional discharge printing and discharge resist printing:

The printing substrate is textile material, for example woven or knitted fabrics made of polyester, cellulose acetate, cellulose triacetate or polyamide or mixtures thereof. Textiles made of said fiber types are known. The dyes used are almost exclusively disperse dyes.

The discharge resist printing process can be carried out for example by first padding the textile material with a liquor containing a dischargeable disperse dye. Instead of being padded, the textile material can also be printed with a print paste which contains a dischargeable disperse dye together with a thickener. The textile material is then dried under conditions gentle enough not to fix the dyes. The textile material is then printed with a mixture of a discharge-resistant disperse dye and the discharging agent according to the invention and dried. The dyes are then fixed, for example by thermosoling or heating in a superheated steam atmosphere. Under these conditions, the dischargeable dye is destroyed in those areas which were printed with the mixture of the discharge-resistant dye and the discharging agent. This technique is referred to as discharge resist printing between the dye used to produce the colored ground was never fixed.

In a variation of the discharge resist process, the mixture of discharge-resistant dye and reducing agent is printed onto the textile material, followed immediately by uniform application of the dischargeable dye, the material is then dried, and the dyes are fixed. In discharge printing, by contrast, a dischargeable dye which has been previously fixed on the fabric is discharged with the discharging agent mixture applied in a pattern. In all versions of the process it is also possible to discharge to white using a print phase which contains a discharging agent mixture but no dye.

In the case of polyester, the dyeings can be carried out not only using carriers but also under high temperature conditions, for example dyeing under pressure, from an aqueous liquor at 120° C. The subsequent reduction clear required on polyesters is carried out following the printing and fixation steps by reduction clearing the ground and the resistant multicolored areas in one step. The advantage of dyeings is the better levelness of the ground, which is particularly important when the design pattern dictates that only small individual areas are to be discharged. A prior dyeing has qualitative advantages in particular on knitwear and very lightweight woven fabrics. Acetate and polyamide fibers and blends thereof are dyed at 85° C.

As mentioned above, the process according to the invention is performed almost exclusively with disperse dyes. Suitable dyes of this type can be found in the Colour Index. Dischargeable disperse dyes are those which are decomposed by the discharging agent into products which in general should not impair the white ground or the multicolored pattern. They are in particular disperse dyes derived from azo dyes. The discharge-resistant dyes are in the main disperse dyes based on anthraquinone derivatives. They are resistant to the discharging agent.

The print paste with which the discharging agent according to the invention is printed onto the textile material in general contains a thickener to adjust the viscosity. Preference is given to using natural thickeners, such as bean flour ethers, for example locust bean flour ether, or starch ether thickenings, such as guar ether, etherified cellulose or starch, and alginates. In general, 1000 parts of the ready-prepared print paste contain from 20 to 100 parts by weight of a natural thickener. It is also possible to use synthetic thickeners. Suitable synthetic thickeners are for example high molecular weight polycarboxylic acids, for example polyacrylic acid, copolymers of ethylene and acrylic acid, and copolymers of styrene and maleic anhydride, whose carboxyl groups may all or in part be neutralized.

Discharge-resistant disperse dyes can be found for example in the Colour Index. Some examples of discharge-resistant disperse dyes are: yellow disperse dyes CI 58900 and CI 47023, orange disperse dye CI 60700, red disperse dyes CI 60755, CI 62015 and CI 60756, violet disperse dye CI 61105 and blue disperse dyes CI 61500, CI 62500 and CI 63285.

1000 parts by weight of print paste contain from 0.5 to 50 parts by weight of a disperse dye or of a mixture of disperse dyes.

The print pastes containing the discharging agent according to the invention, thickeners and discharge-resistant disperse dyes may further contain the assistants known to those skilled in the art, such as, based on the total weight, for example from 3 to 5% by weight of urea or thiourea, from 0.1 to 0.3% by weight of foam suppressant or from 8 to 12% by weight of assistants such as polyethylene glycol, phenylglycine, dicarboxylic acids or anthraquinone-2-sulfonic acid. The difference to 100% by weight is water.

Accordingly, it is possible to specify a general guideline recipe for a print paste for discharge or discharge resist printing as follows:

from 1 to 10% by weight, preferably from 5 to 7% by weight, of an aminoreductone of the formula I or an acid addition salt thereof, from 2 to 10% by weight, preferably from 6 to 7% by weight, of a natural or synthetic thickener, optionally from 0.5 to 5% by weight of a discharge-resistant disperse dye, from 3.0 to 5.0% by weight of urea or thiourea, from 0.1 to 0.3% by weight of a foam suppressant, from 8 to 12% by weight of a fixing assistant and up to 100% by weight of water.

Suitable dischargeable disperse dyes can likewise be found in the Colour Index. They are essentially azo dyes. Specific examples are the yellow disperse dye CI 11855 and the red disperse dyes CI 11150 and CI 11115.

In the Examples, the parts and percentages are by weight.

EXAMPLES

Preparation of aminoreductones

In what follows, the radical

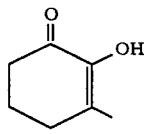

will be designated radical A.

The preparation of the aminoreductones is carried out under nitrogen.

Aminoreductone 1

A—NH—$CH_2$—COOH

A solution of 150 g (2 mol) of glycine and 450 ml of water is admixed with 106.5 g (0.83 mol) of A—OH and 75 ml of 2N hydrochloric acid by stirring and heated to the boil. At about 40° C. a clear solution forms, from which the product begins to precipitate at about 80° C. Once the boiling temperature has been reached, the mixture is cooled down to 10° C., and the precipitate, a yellowish crystalline powder, is worked up as usual. Recrystallization from hot isopropanol gives the aminoreductone in an 88% yield in the form of colorless crystals of melting point 185°-187° C.

Aminoreductone 2

A—NH—$CH_2$—$CH_2$—COOH

A mixture of 214 g (2.4 mol) of β-alanine, 256 g (2.0 mol) of A—OH, 0.5 g of p-toluenesulfonic acid and 500 ml of toluene is heated at the boil for about an hour with removal of the water of reaction. After cooling down to room temperature, the product is filtered off with suction and recrystallized from methanol. Yield 60%, melting point 178°-180° C. On working up, the mother liquor gives a further 15% yield.

Aminoreductone 3

(A—NH—$CH_2$—$CH_2$—$COO^-$)$_2Ca^{++}$ 180 g (0.9 mol) of the compound of Example 2 are suspended in 3 l of water under $N_2$ and admixed with 33.5 g (0.45 mol) of $Ca(OH)_2$ added a little at a time. The solution which forms is concentrated in a water jet vacuum at <60° C., the last traces of water being removed azeotropically with toluene, added for the purpose. The residue of about 210 g is stirred into 300 ml of methanol, cooled down in an ice bath and filtered off with suction. Drying leaves 192 g of an almost colorless product which contains 3 mol of water of crystallization and has a melting point of 150°-160° C.

Aminoreductone 4

A—NH—$CH_2$—$CH_2$—$COO^-Na^+$ 115 g (0.56 mol) of the compound of Example 2 are suspended in 700 ml of water and admixed, by stirring, with 47 g (0.56 mol) of $NaHCO_3$ added a little at a time; a foam forms and $CO_2$ escapes. The solution is subsequently stirred for a further 30 minutes and then concentrated in a water jet vacuum at <60° C. The residue is dried in a vacuum drying cabinet at <80° C. 114 g are obtained of a colorless product having a melting point of 210°-215° C.

Aminoreductone 5

A—NH—n—$C_{12}H_{25}$

A mixture of 145 g (0.78 mol) of dodecylamine, 100 g (0.78 mol) of A—OH, 1 g of p-toluenesulfonic acid and 50 ml of toluene is heated at the boil for about one hour with distillative removal of the water of reaction and is then admixed at 60° C. with 500 ml of n-hexane. On further cooling the product precipitates as a yellowish mass of crystals. The yield of pure compound recrystallized from n-hexane in the form of colorless leaflets is 81%, the melting point being 79°-81° C.

Aminoreductones 6 to 9

Example 5 was followed to prepare the following compounds:

| Example | Compound | Melting point °C. | Yield % |
|---|---|---|---|
| 6 | A—NH—$CH_2CH_2$—OH | 164-165 | 63 |
| 7 | A—NH—CH(CH$_3$)—COOH | 227-229 | 51 |
| 8 | A—NH—CH(CH$_3$)—$COO^-Na^+$ | >210 | 93 |
| 9 | A—NH—($CH_2CH_2$—O)$_2$H | 85-89 | 52 |

APPLICATION EXAMPLES

EXAMPLE 1

A polyester fabric is dyed at 120° C. in an HT machine from an aqueous liquor containing the following dye composition:

8.5% of C.I. Disperse Blue 106
0.7% of C.I. Disperse Yellow 5
0.3% of C.I. Disperse Red 224
1.8% of C.I. Disperse Red 118
0.6% of C.I. Disperse Blue 149.

The fabric is then rinsed and dried at not more than 100° C. A black dyeing is obtained.

The fabric thus dyed is printed in a pattern with a print paste of the following composition:

| | |
|---|---|
| 600 g | of guar ether thickening of pH 7 (120 g guar ether in 1000 g of water) |
| 100 g | of a mixture of polyethylene glycol (molecular weight about 300) and phenylglycine (about 2:1) |
| 50 g | of aminoreductone 4 |
| 40 g | of the blue disperse dye C.I. Disperse Blue 56 |
| 210 g | of water |
| 1000 g | |

The printed material is dried and then steamed with superheated steam at 175° C. under atmospheric pressure for 15 minutes.

This is followed by a cold rinse and a customary reduction clear. A blue print is obtained on the black ground.

Similar effects are obtained with aminoreductones 1 to 3.

EXAMPLE 2

A 65% secondary acetate and 35% polyamide blend fabric is dyed with 5% of C.I. Disperse Blue 106 at 80° C., rinsed and dried.

A dark blue dyeing is obtained. The dye has been fixed.

The dyeing thus obtained is then printed with the following print paste:

| | |
|---|---|
| 600 g | of guar ether thickening of pH 7 (120 g of guar ether in 1000 g of water) |
| 100 g | of a mixture of polyethylene glycol (molecular weight 300) and phenylglycine (about 2:1) |
| 50 g | of a dicarboxylic acid mixture |
| 50 g | of thiourea |
| 50 g | of anthraquinone-2-sulfonic acid |
| 50 g | of aminoreductone 4 |
| 40 g | of the red disperse dye C.I. Disperse Red 11 |
| 60 g | of water |
| 1000 g | |

The printed fabric is dyed and then steamed with saturated steam at 102° C. under atmospheric pressure for 20 minutes.

This is followed by a cold rinse, soaping at 40° C., rinsing and drying. A deep red print is obtained on the blue ground.

Similar effects are obtained on using aminoreductones 5 to 9.

EXAMPLE 3

A polyester fabric is padded with a liquor containing the following constituents:

60 g/l of C.I. Disperse Blue 148
25 g/l of C.I. Disperse Red 118
5 g/l of C.I. Disperse Yellow 198
10 g/l of a copolymer of acrylic acid and acrylamide, partially neutralized with sodium hydroxide solution,
5–10 g/l of the sodium salt of nitrobenzenesulfonic acid.

The pH of the padding liquor is adjusted to pH 5.5 with monosodium phosphate. The wet pickup is 60–70%.

After it has been padded the fabric is dried at 90°–100° C. The dyes have not been fixed. The fabric is then printed with a print paste of the following composition:

600 g of guar ether thickening of pH 7 (120 g of guar ether in 1000 g of water)
100 g of a mixture of polyethylene glycol MW 300 and phenylglycine
50 g of aminoreductone 4
40 g of the red disperse dye C.I. Disperse Red 352
210 g of water.

The printed material is dried and then steamed with superheated steam at 175° C. under atmospheric pressure for 15 minutes. This is followed by a cold rinse and a customary reduction clear.

A bright red print is obtained on a black ground.

We claim:

1. A process for printing a textile material made of polyester, triacetate, acetate or polyamide or a mixture thereof with a disperse dye by the discharge printing or discharge resist printing technique, which comprises using as the discharging agent a 3-aminoreductone of the general formula

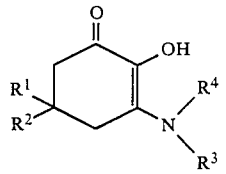

I where $R^1$, $R^2$ and $R^3$ are identical or different and each is hydrogen, methyl or ethyl and $R^4$ is linear or branched alkyl or alkenyl of from 1 to 20 carbon atoms, which may be monosubstituted or polysubstituted by hydroxyl, alkoxy of from 1 to 3 carbon atoms in the alkyl or acetoxy, or is a radical $-(CH_2-CH_2-O)_nH$ where n is from 1 to 10 and which may be etherified with alkyl of from 1 to 3 carbon atoms or esterified with acetyl, or $R^4$ together with the N-atom is the radical of an aliphatic α- or β-amino acid of from 2 to 15 carbon atoms, where the carboxyl group may be present in neutralized form as an alkali metal, alkaline earth metal or ammonium salt or in esterified form as a $C_1$–$C_{10}$-alkyl ester, or a mineral acid salt thereof.

2. A process as claimed in claim 1, wherein the discharging agent used is an aminoreductone of the formula I, or a mineral acid salt thereof, where $R^1$, $R^2$ and $R^3$ are each hydrogen and $R^4$ is linear or branched alkyl of from 8 to 14 carbon atoms, hydroxyethyl or hydroxyethoxyethyl (n=2), or $R^4$ together with the N-atom is the radical of an α- or β-amino acid of from 2 to 6 carbon atoms, where the carboxyl group may be present in neutralized form as a sodium, potassium, calcium, magnesium or ammonium salt.

3. A process as claimed in claim 1, wherein the discharging agent used is an aminoreductone of the formula I where $R^1$, $R^2$ and $R^3$ are each hydrogen and $R^4$ is together with the N-atom a glycine, β-alanine, α-alanine or ϵ-aminocaproic acid radical, in each of which the carboxyl group may be present as a sodium, potassium, calcium, magnesium or ammonium salt.

4. A print paste for discharge printing or discharge resist printing, containing as discharging agent from 1 to 10% by weight of an aminoreductone of the formula I as defined in claim 1, from 2 to 10% by weight of thickener, from 0.5 to 5.0% by weight of a discharge-resistant disperse dye, an optional customary assistant, and water to make up to 100% by weight.

* * * * *